United States Patent [19]

Mochizuki et al.

[11] 4,326,550

[45] Apr. 27, 1982

[54] CONSTRUCTION OF CHANGE HOLDER FOR USE IN ELECTRONIC CALCULATING MACHINE

[75] Inventors: Daisuke Mochizuki, Nara; Toshio Sugitani, Yamatokoriyama, both of Japan

[73] Assignee: Sharp Kabushiki Kaisha, Osaka, Japan

[21] Appl. No.: 96,401

[22] Filed: Nov. 21, 1979

[30] Foreign Application Priority Data

| | | | |
|---|---|---|---|
| Nov. 21, 1978 | [JP] | Japan | 53-161279[U] |
| Nov. 27, 1978 | [JP] | Japan | 53-163511[U] |
| Dec. 6, 1978 | [JP] | Japan | 53-151237 |
| Dec. 6, 1978 | [JP] | Japan | 53-151238 |
| Dec. 8, 1978 | [JP] | Japan | 53-152340 |
| Dec. 11, 1978 | [JP] | Japan | 53-170485[U] |
| May 28, 1979 | [JP] | Japan | 54-72011 |
| Jul. 4, 1979 | [JP] | Japan | 54-92621 |

[51] Int. Cl.[3] ..... G07D 1/08

[52] U.S. Cl. ..... 133/2

[58] Field of Search ..... 133/2, 4 R, 4 A, 1 R, 133/1 A, 8 B, 1 A; 221/155; 206/0.81, 0.84

[56] References Cited

U.S. PATENT DOCUMENTS

| | | | |
|---|---|---|---|
| 1,128,889 | 2/1915 | Maier | 133/2 |
| 1,401,957 | 1/1922 | Boulton | 133/1 A |
| 2,127,642 | 8/1938 | Dieserud | 133/2 |
| 2,577,344 | 1/1950 | Masure | 221/155 X |
| 2,936,769 | 5/1960 | Damon | 133/5 R |
| 3,140,765 | 7/1964 | Sundblad et al. | 133/2 X |
| 3,197,009 | 10/1964 | Okolischan | 194/102 X |
| 3,359,993 | 12/1967 | Tryon et al. | 221/155 X |

FOREIGN PATENT DOCUMENTS

| | | | |
|---|---|---|---|
| 318763 | 6/1934 | Italy | 206/0.81 |

*Primary Examiner*—Stanley H. Tollberg

*Attorney, Agent, or Firm*—Birch, Stewart, Kolasch & Birch

[57] ABSTRACT

A change holder is adapted for a coin dispenser incorporated into a housing of an electronic calculating machine comprising a transparent side wall. A window is provided in the housing of the electronic calculating machine, being positioned in front of the transparent side wall of the change holder, so that a certain number of coins stored in the change holder are visible from outside the electronic calculating machine. At least two kinds of railway path plates may be secured adjacent a plurality of coin shelves, respectively, so that coins dispensed from the plurality of coin-shelves are separately led to a saucer through at least one of the two kinds of railway plates.

6 Claims, 13 Drawing Figures

CONSTRUCTION OF CHANGE HOLDER FOR USE IN ELECTRONIC CALCULATING MACHINE

BACKGROUND OF THE INVENTION

The present invention relates to a coin dispenser for use in an electronic cash register and, more particularly, to a construction of a change holder comprising a plurality of coin-shelves each keeping and forwarding respective coins in a specific relationship with an electronic cash register.

Conventionally, a change holder comprised only one pathway connected between a plurality of coin-shelves and a coin saucer. A plurality of coins held within the respective coin-shelves are forwarded through the only pathway from the coin-shelves to the coin saucer. Unity of the pathway had an adverse effect on the transference of the plurality of coins since the plurality of coins to be forwarded may be stopped-up within the saucer. Even if not, the speed at which the plurality of coins are forwarded, is very slow.

Accordingly, it is desirable that the plurality of coins be promptly forward from the coin-shelves to the saucer with accuracy.

SUMMARY OF THE INVENTION

Accordingly, it is an object of the present invention to provide an improved construction of a change holder comprising a plurality of coin-shelves each containing a number of coins of the same kind, the change holder being operatively connected to an electronic calculating machine.

It is a further object of the present invention to provide an improved combination of a change holder and an electronic calculating machine, wherein a side wall of the change holder is transparent and, in addition, a window is provided in the housing of the electronic calculating machine.

It is a further object of the present invention to provide an improved construction of a change holder comprising a plurality of coin-shelves to which there are connected at least two pathways used for permitting a plurality of coins to separately pass at a rapid speed and with accuracy.

It is a further object of the present invention to provide an improved change holder for use in an electronic calculating machine, the change holder comprising a plurality of coin-shelves and being easily removable from the body of the electronic calculating machine.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a change holder comprising a transparent sidewall is adapted for a coin dispenser incorporated into the housing of an electronic calculating machine. A window is provided in the housing of the electronic calculating machine, being positioned in front of the transparent side wall, so that a certain number of coins stored in the change holder are visible from outside the electronic calculating machine.

At least two kinds of railway means may be secured adjacent a plurality of coin shelves, respectively, so that coins dispensed from the plurality of coin-shelves are separately led to a saucer through one of the two kinds of railway means.

BRIEF DESCRIPTION OF THE DRAWINGS

The present invention will become more fully understood from the detailed description given hereinbelow and accompanying drawings which are given by way of illustration only, and thus are not limitative of the present invention and wherein.

DESCRIPTION OF THE INVENTION

Figure 1:
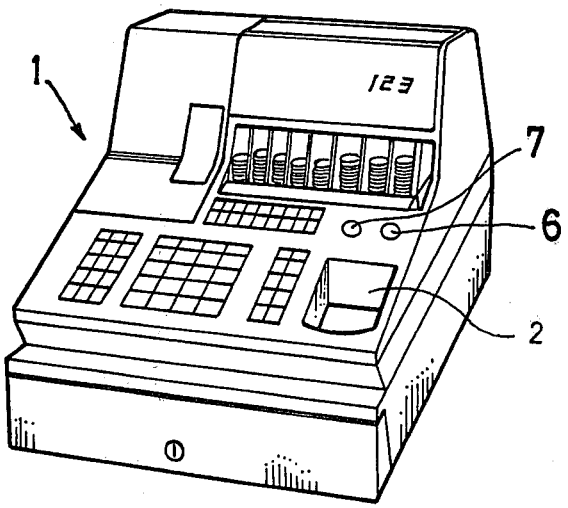
FIG. 1 is a perspective view of an electronic calculating machine encompassing a change holder of the present invention therein.

FIG. 1 shows an electronic calculating machine 1 incorporating a change or coin holder of the present invention therein. The electronic calculating machine 1 has various electronic parts as the well-known machines. In addition, a change or coin holder of the present invention is accommodated within the body of the electronic calculating machine 1.

The change or coin holder of the present invention is activated in connection with the electronic calculating machine 1 so that a plurality of coins respectively stored within a plurality of coin-shelves provided in the coin holder are forwarded as described below. A saucer 2 is formed within the outside housing of the electronic calculating machine 1. The saucer 2 receives the plurality of coins from the plurality of coin-shelves.

The electronic calculating machine 1 further comprises a clerk key 6 and a mode selection key 7. The clerk key 6 is operable to identify a clerk by selection. The mode selection key 7 is operated to select modes of the electronic calculating machine 1 where exact calculation operations and inspection procedures for the electronic calculating machine 1, and the like are performed.

A large area is necessary for a kit for the clerk key 6 and the mode selection key 7. Accordingly, there was difficulty in determining the space for the kit due to the presence of a pathway for the plurality of coins.

According to the present invention, the kit for the clerk key 6, the mode selection key 7, and another key unit is readily secured on the electronic calculating machine 1. The kit is secured between the saucer 2 and the plurality of coin-shelves.

Figure 2:
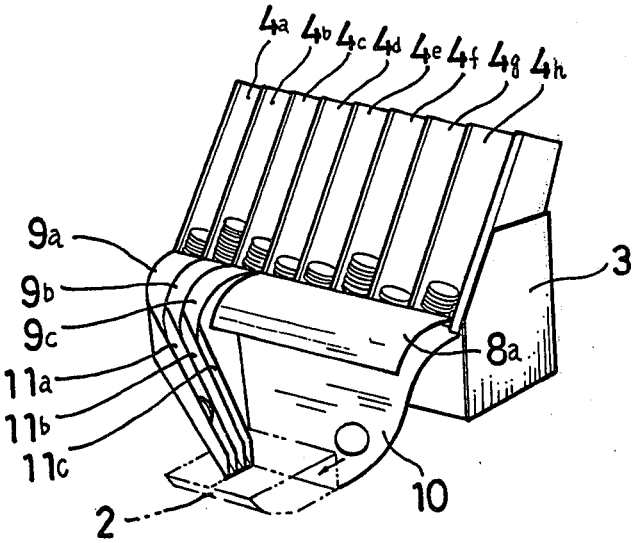
FIG. 2 is a perspective view of an example of a change holder of the present invention.

FIG. 2 shows an example of the coin-holder of the present invention in a perspective view. The coin holder comprises a change developing device 3, a plurality of coin-shelves 4*a* to 4*h*, a plurality of reflection plates 8*a* and 9*a* to 9*c*, a railway plate 10, a plurality of pathway plates 11*a* to 11*c*, and the above saucer 2.

The plurality of coin-shelves 4*a* to 4*h* hold a number of coins of the same kind, respectively. The coins are forwarded from the respective coin-shelves 4*a* to 4*h* to the saucer 2 in response to activation by means of a forwarding member provided within the change developing device 3. The forwarding member is positioned behind the respective coin-shelves 4*a* to 4*h*. The forwarding member may comprise a lever or the like.

The railway plate 10 is secured to receive the plenty of coins transferred from a first group of coin-shelves, e.g., 4*d* to 4*h*. On the other hand, the pathway plates 11*a* to 11*c* are positioned to form an appropriate number of pathways, say, three, through which the coins stored in a second group of coin shelves, e.g., the coin-shelves 4*a* to 4*c* should be transferred, respectively.

The outlets of the pathways plates 11*a* to 11*c* reaches to the saucer 2. The edge of the railway plate 10 is connected to the saucer 2 so as to deliver the coins from the coin-shelves 4*d* to 4*h*. There is produced a large space in front of the reflection plate 8*a* and the railway plate 10, and then beside the pathway plates 11*a* to 11*c*, and in addition, on the upper of the saucer 2. The kit for the clerk key 6, the mode selection key 7, and the like is positioned at the space.

The reflection plate 8*a* is connected to the coin-shelves 4*d* to 4*h* to reflect the coins developed from the coin-shelves 4*d* to 4*h* into the surface of the railway plate 10. The other reflection plates 9*a* to 9*c* are respectively combined to the pathways plates 11*a* to 11*c* to transfer the coins sent from the coin-shelves 4*a* to 4*c* to them. The reflection plates 8*a* and 9*a* to 9*c* are made of thin metallic material or so.

The coins from the coin-shelves 4*a* to 4*c* rotate along grooves formed with the pathway plates 11*a* to 11*c*. The coins from the coin-shelves 4*d* to 4*h* slip along the surface of the railway plate 10. The coin-shelves 4*a* to 4*c* are rather far from the saucer 2 whereas the coin-shelves 4*d* to 4*h* are fairly close to the same.

Figure 3:
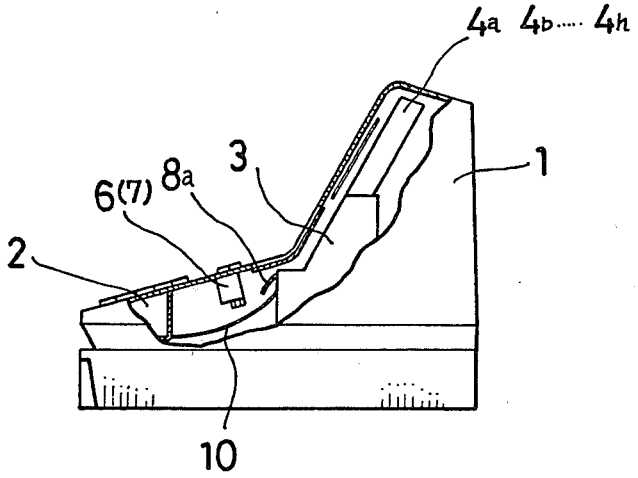
FIG. 3 is a side view with certain parts broken away of the electronic calculating machine shown in FIG. 1, incorporating the change holder shown in FIG. 2.

FIG. 3 is a side view with certain parts broken away of the electronic calculating machine 1 carrying therein the coin holder of the present invention. Like elements corresponding to those of FIGS. 1 and 2 are indicated by like numerals.

In accordance of a specific form of the present invention, the coins developed from the respective coin-shelves are rapidly forwarded to the saucer 2 with accuracy since there are at least two types of pathways as defined with the railway plate 10 and the pathways plates 11*a* to 11*c*.

Figure 5:
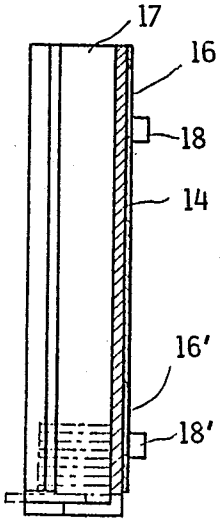
FIG. 5 is a fragmentary view in vertical section of the change holder shown in FIG. 4.
Figure 4:
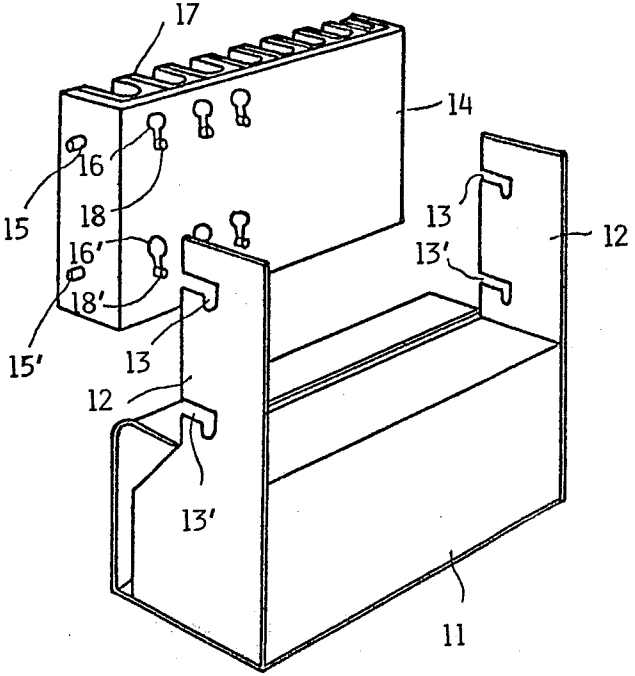
FIG. 4 is a perspective view of a further example of a change holder of the present invention.

FIG. 4 shows a construction of a further example of a coin holder according to another specific form of the present invention. FIG. 5 shows a fragmentary view in vertical section of the coin holder shown in FIG. 4.

With reference to FIGS. 4 and 5, there are indicated a coin dispenser body 11, a pair of frames 12, four notches 13 and 13', a supporting plate 14, a pair of bosses 15 and 15', a plurality of openings 16 and 16', a plurality of coin-shelves 17, and a plurality of hooks 18 and 18'.

The coin dispenser body 11 contains a control unit operable for regulating the delivery of the coins stacked within the plurality of coin-shelves 17 as a coin holder. The control unit comprises a plurality of levers or the like for being driven to hit the coins stored in the respective coin-shelves 17. An appropriate number of levers or the like corresponding to that of the coin-shelves 17 are disposed. The coins are dispensed from the bottom of the respective coin-shelves 17. The levers or the like are actuated in response to control signals developed from the control unit.

The pair of frames 12 and 12' extend so as to accommodate therebetween the coin holder comprising the plurality of coin-shelves 17 unified or joined with the supporting plate 14. A pair of notches 13 and 13' are formed in an L-shape within each of the frames 12 and 12'. The pair of notches 13 and 13' are disposed to be connectable with the pair of bosses 15 and 15', respectively positioned on two sides of the supporting plate 14. The U-bent supporting plate 14 is put between the pair of frames 12 and 12', in which case the bosses 15 and 15' are respectively connected to the notches 13 and 13'.

The openings 16 and 16' are formed in the supporting plate 14 so as to be utilized for supporting a piece of the coin-shelf by being connected with a couple of the hooks 18 and 18' disposed behind the coin-shelf. The openings 16 and 16' have respectively a wider bore portion and a narrower bore portion as indicated in FIG. 4. Through the wider bore portion of the openings 16 and 16', the hooks 18 and 18' protrude without any engagement therebetween. At the narrower bore portion thereof, they are supportably engaged to the openings 16 and 16'.

In accordance with the above described construction, the coinshelves are removably connected as a unit to the supporting plate 14 with the connection between the hooks 18 and 18', and the openings 16 and 16', respectively. The supporting plate 14 is provided for binding the plurality of coin-shelves 17 in a unit. The supporting plate 14 containing the plurality of coin-shelves 17 is interposed between the pair of frames 12 and 12' with the engagement between the notches 13 and 13', and the bosses 15 and 15', respectively. In which case the coins stacked within the respective coin-shelves 17 are dispensed in turn with the control by the control unit. Therefore, the respective units of the coin-shelves can be independently removed from the supporting plate 14 and, in addition, the supporting plate 14 can be further separated from the coin dispenser body 11. Accordingly, a supplement and removement of the coins into and from the coin-shelves can be simplified.

Figure 6:
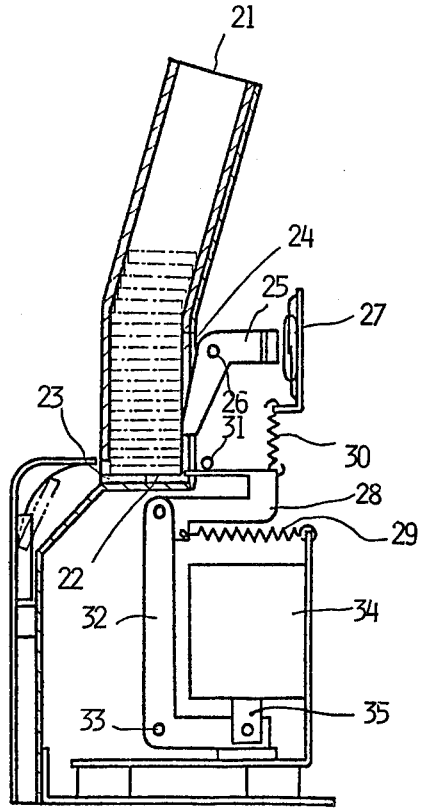
FIG. 6 is a fragmentary view in vertical section of a further example of a coin-shelf according to the present invention.

FIG. 6 shows a further example of a coin-shelf in a fragmentary view in vertical section according to a further embodiment of the present invention. A feature of the coin-shelf shown in FIG. 6 is to arrange that the coin-shelf is raked at a different angle from an appropriate point thereof. It is for the purpose of reducing load applied to a coin which is positioned at the bottom within the coin-shelf.

With reference to FIG. 6, there are illustrated a coin-shelf 21, a bottom portion 22 of the coin-shelf 21, a dispensing outlet 23, a slit 24, a lever 25, a pivot 26, a switch 27, a despensing lever 28, two springs 29 and 30, a bar 31, an L-bent lever 32, another pivot 33, a solenoid 34, and a lever 35.

The coin-shelf 21 has a bent tube in which a plurality of coins are stacked. The coin-shelf 21 can be removed from a coin dispenser device comprising all other parts except for itself. At the lower portion of the coin-shelf 21, there are disposed the bottom portion 22, the dispensing outlet 23, and the slit 24. The plurality of coins are stacked on the bottom portion 22. The dispensing outlet 23 passes the coins emitted from the coin-shelf 21. The slit 24 is disposed so that the lever 25 can be introduced into the bent tube of the coin-shelf 21.

The lever 25 is provided for detecting the existence of an appropriate number of the coins within the bent cube of the coin-shelf 21.

If an appropriate number of the coins are stored within the bent tube, the end of the lever 25 is rendered to be outwardly forced by the coins, the end being in contact with the coins. When the end of the lever 25 is no longer in contact with them, the lever 25 is rotated in a clockwise direction around the pivot 26, which is fixed.

Therefore, the other end of the lever 25 becomes in contact with the switch 27, thereby indicating that a certain number of the coins are no longer stored in the bent tube of the coin-shelf 21.

The dispensing lever 28 pushes one of the coins stacked on the bottom portion 22 forwards so that the pushed coin is forwarded through the dispensing outlet 23. When the dispensing lever 28 should not be driven to force any of the coins, the dispensing lever is pulled by the spring 29 outwardly of the bent tube and then suspended by the spring 30 upwardly and, in addition, restricted from moving by means of the bar 31.

The L-bent lever 32 is movably coupled to the pivot 33. The end of the L-bend lever 32 is connected to the dispensing lever 28. The other end of the L-bent lever 32 is rotatably engaged to the lever 35 connected to the solenoid 34.

In accordance with the above-stated arrangement, the solenoid 34 is firstly activated in response to check information developed from a control unit of the electronic calculating machine. The activation of the solenoid 34 pulls the lever 35 connected to the L-bend lever 32 so that the L-bend lever 32 is rotated in a counterclockwise direction along the pivot 33 regardless of the pull by means of the spring 29. According to the rotation of the L-bend lever 32, the dispensing lever 28 is horizontally shifted to cause impact on one of the coins stacked on the bottom portion 22. The forced coin is emitted from the inside of the bent cube through the dispensing outlet 23.

After forcing one coin, the dispensing lever 28 is recovered to the initial position by means of the pull of the spring 29. The remaining coins except the forwarded coin drop down spontaneously on the bottom portion 22.

A feature of this arrangement is to provide the bent tube as the inside of the coin-shelf 21 so as to reduce load by all the coins except the bottom coin stored in the coin-shelf, the load being all applied on the bottom coin. Since the coin-shelf 21 is bent at an appropriate portion thereof, a certain part of the load derived by the coins positioned on the bent portion is applied directly to the wall of the bent tube of the coin-shelf 21. Accordingly, the load by the coins positioned on the bent portion to be applied to the bottom coin is reduced.

Therefore, it becomes useful that the dispensing lever 28 forces the bottom coin only by means of a small amount of power for dispensing purposes. Then the solenoid 34 can be simplified and compact.

Figure 7:
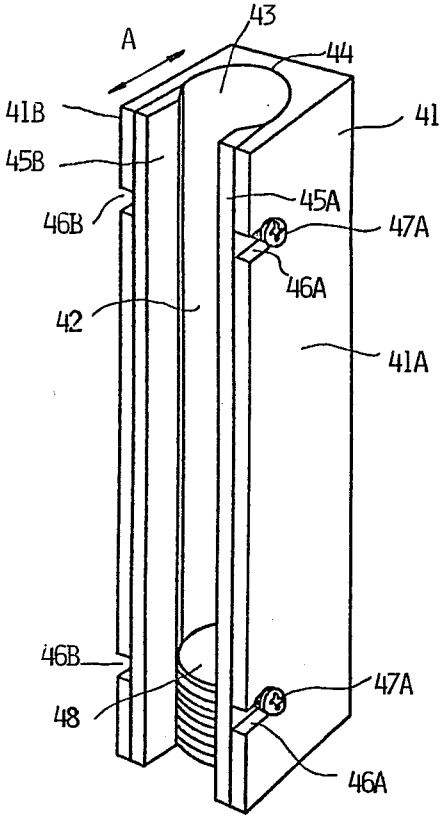
FIG. 7 is a perspective view of a further example of a coin-shelf according to the present invention.

FIG. 7 shows a further example of a construction of a coin-shelf according to a further embodiment of the present invention. Referring to FIG. 7, there is indicated a coin-shelf containing a major body 41, an opening 42, a U-shaped tube portion 43, a circle portion 44, a pair of guide plates 45A and 45B, four notches 46A and 46B, and two screws 47A. A plurality of coins 48 are stacked with the coin-shelf.

The opening 42 is provided so that the major body 41 is constituted by three side walls of a suitable material. The U-shaped tube 43 is rendered to be open at the portion positioned by the openings 42. The U-shaped tube portion 43 is disposed inside of the major body 41, containing the plurality of coins 48 as viewed in FIG. 7. The U-shaped tube 43 has therein the circle portion 44 the bore of which is selected to be more than that of any of the coins 48 which should be stored in the U-shaped tube 43. Hence, the width of the opening 42 is equivalent to the diameter defining the circle portion 44.

Each of the guide plates 45A and 45B is positioned on two side walls 41A and 41B of the major body 41, the two side walls 41A and 41B opposing each other. The guide plates 45A and 45B both have enough extension to lead the stacked coins to the bottom of the coin-shelf. Edges of the guide plates 45A and 45B in contact with the stacked coins taper.

The guide plate 45A is connected to the side wall 41A with the use of the screws 47A protruding from the two notches 46A provided on the side wall 41A. Although not shown in FIG. 7, a pair of screws are further provided for coupling the guide plate 45B in relation with the different two notches 46B disposed in the side wall 41B.

The four notches 46A and 46B are formed in the respective side walls 41A and 41B so that the former have an area horizontally extended as indicated by an arrow A. Therefore, the inside defined by the U-shaped tube portion 43 and the guide plates 45A and 45B is selected by adjusting a portion engaged between the screws 47A and 47B, and the guide plates 45A and 45B. The selection of the area in the inside should be dependent on the size of the coins which should be stored in the inside.

When the guide plates 45A and 45B are coupled with the screws 47A and 47B which are positioned at the innermost portion of the notches 46A and 46B, the inside defined by the U-shaped tube portion 43 and the guide plates 45A and 45B is the smallest. On the other hand, when the screws 47A and 47B are disposed at the outermost portion of the same, the inside is the largest.

In accordance with this specific construction, the coin-shelf 41 becomes adjustable for any kind or size of coin.

Figure 9:
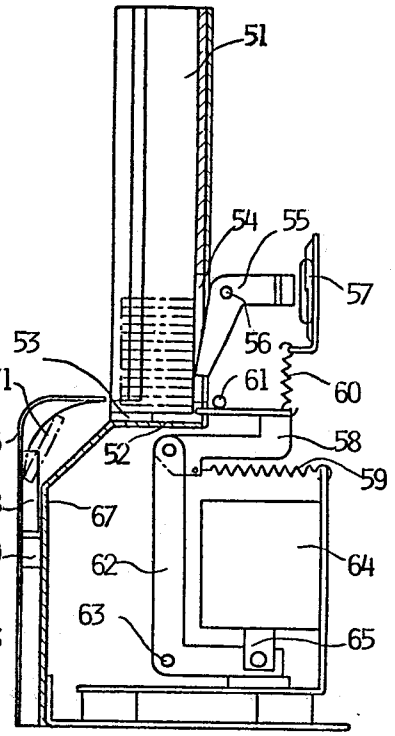
FIG. 9 is a fragmentary view in vertical section of the coin dispenser shown in FIG. 8.
Figure 8:
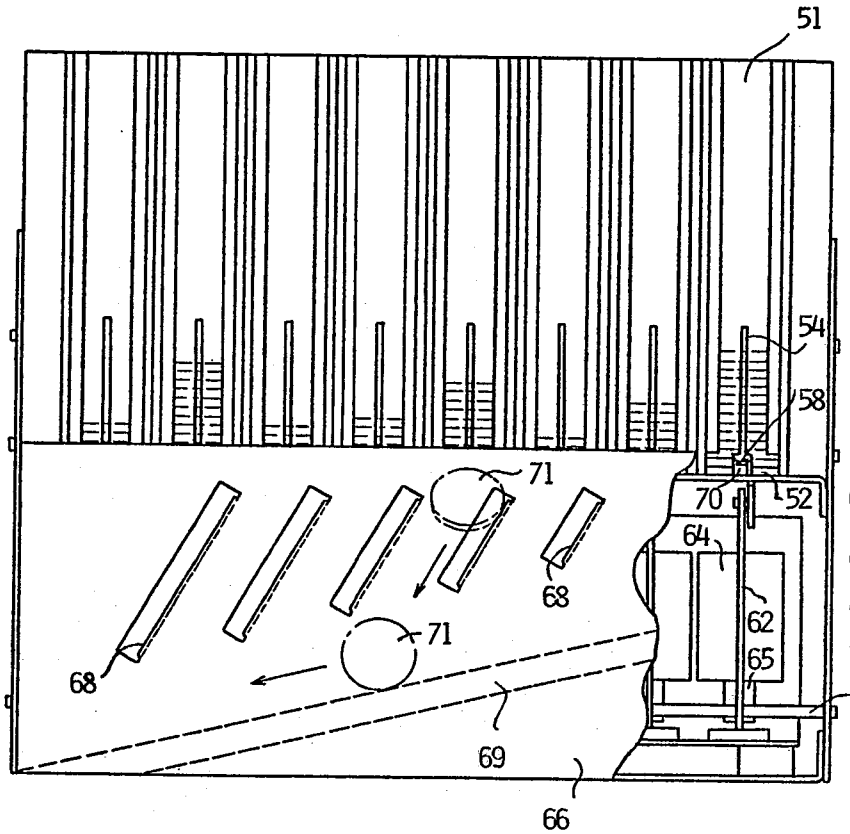
FIG. 8 is a front view with certain parts broken away of a further example of a coin dispenser according to a further embodiment of the present invention.

FIG. 8 shows a further example of a coin dispenser according to a further embodiment of the present invention. FIG. 9 is a fragmentary view in vertical section of the coin dispenser shown in FIG. 8.

In FIGS. 8 and 9, elements denoted as 51 to 64 are related to those parts indicated by numerals 21 to 35 in FIG. 6, respectively, with the exception that the coin-shelf 51 is not bent but straight. Therefore, detailed description thereof is omitted.

With reference to FIGS. 8 and 9, there are provided a front panel 66, a rear panel 67, a plurality of inclined plates 68, a dispensing railway 69, and an inlet portion 70.

The front panel 66 and the rear panel 67 form in combination a room in which the dispensing railway 69 is disposed. A coin 71 dispensed from the coin-shelf 51 rotates downward along the dispensing railway 69. The plurality of inclined plates 68 are comprised of rectangular plates cut out from the front panel 66 and bent toward the rear panel 67. The number of the inclined plates 68 corresponds to that of the coin-shelves 51. The respective coin-shelves 51 are appropriately inclined with respect to the surface of the dispensing railway 69. The inside surface of the front panel 66 curves so that the coin 71 dispensed can be smoothly led to the respective inclined plates 68.

The width of the inclined plates 68 is substantially equivalent to that of the interval between the front and the rear panels 66 and 67. It is arranged that the gap between the lowest edges of the inclined plates 68 and the surface of the dispensing railway 69 is somewhat wider than the diameter of the coin 71 which should rotate on the dispensing railway 69 under the condition that the coin 71 has been received by the related inclined plate 68. The intervals between the respective inclined plates 68 each other are also selected to be wider than the diameter of the coin 71.

Through the inlet portion 70 provided on the side of the coin-shelf 51, the dispensing lever 58 is inserted into the inside of the coin-shelf 51 for the purpose of forcing out one of the stacked coins.

Under the circumstances, the coin 71 now dispersed is led to the inclined plate 68 with the help of the curved inner surface of the front panel 66. The coin falls down along the inclined plate 68 and is led to the dispensing railway 69 since the width of the inclined plate 68 is substantially equal to the interval between the front and the rear panels 66 and 67. The coin 71 dropping on the dispensing railway 69 rotates the same toward a saucer (not shown).

As the inclined plate 68 receives the coin 71 obliquely, acceleration added to the coin 71 by means of the dispensing lever 58 is not considerably reduced. Therefore, the coin 71 is rapidly transferred from the inclined plate 68 to the dispensing railway 69 and then to the saucer. There is the additional advantage that only a small sound is caused by the collision of the coin 71 to the dispensing railway 69 since there are disposed the respective inclined plates 68 between the dispensing railway 69 and the dispensing outlet 53 of the coin-shelves 51.

Figure 10:
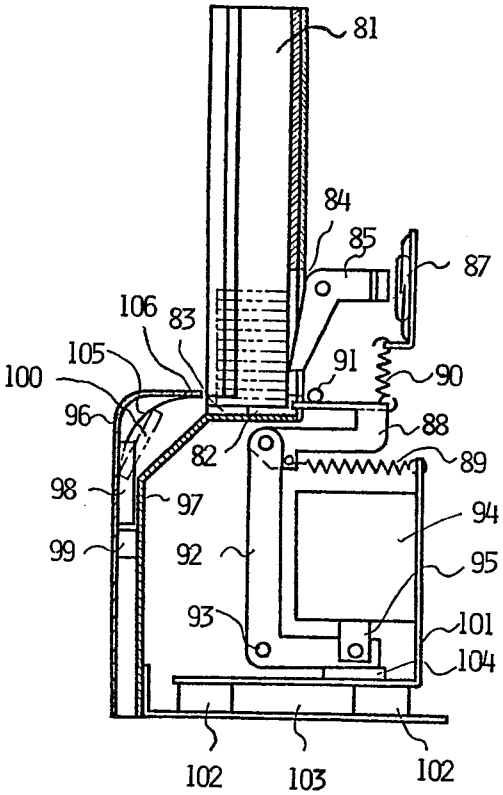
FIG. 10 is a fragmentary view in vertical section of a further example of a coin dispenser according to a further embodiment of the present invention.

FIG. 10 is a fragmentary view in vertical section of a further example of a coin dispenser according to a further embodiment of the present invention. In FIG. 10, all the elements denoted as numerals 81 to 100 are related to those parts indicated by numerals 51 to 71 in FIG. 9, respectively. Therefore, detailed description thereof is omitted.

In addition, in FIG. 10, there are further provided a solenoid installation plate 101, a pair of vibration restriction elements 102, a frame 103, a rubber cushion 104, and a reflection member 105.

The solenoid 54 is supported by the solenoid installation plate 101. The solenoid installation plate 101 is disposed on the frame 103 with protection by means of the pair of vibration restriction elements 102. The rubber cushion 104 is provided for positioning the lever 95 connected to the solenoid 94. The reflection member 105 is disposed inside the front panel 96 and in front of the dispensing outlet 83. An end 106 of the reflection member 105 is coupled to the front panel 96 in front of the dispensing outlet 83. The other end of the same is free. The reflection member 105 is made of any elastic material such as spring or so.

A feature of the above-described arrangement is to function that the reflection member 105 of a parabolic surface receives the coin 100 dispersed from the coin-shelf 81 and leads it to the inclined plate 98. Thereafter, the coin 100 is transferred from the inclined plate to the dispensing railway 22 as described in connection with FIGS. 8 and 9. According to the reflection member 105, the coin 100 can be smoothly led to the inclined plate 98.

The coin 100 dispersed is protected by the reflection member 105 from being broken off. A considerable degree of sound provided by the delivery of the coin 100 dispersed is reduced by the reflection member 105.

The solenoid 94 is positioned so that the lever 95 shifts with keeping right angles in connection with the direction along which the dispersing lever 88 is oriented. A considerable compact space is sufficient to pack the solenoid 94. As the lever 95 connected to the solenoid 94 vertically moves, only a small amount of friction is caused between the lever 95 and a bobbin provided within the solenoid 94.

The lever 95 can be driven with a small amount of power developed by means of the solenoid 94. Accordingly, the consumption energy dissipated within the solenoid 94 becomes very small. The lifetime of the solenoid 94 is also greatly extended. The vibration and the noise due to the energization of the solenoid 94 are reduced with the help of the pair of vibration restriction elements 102 and the rubber cushion 104.

Figure 11:
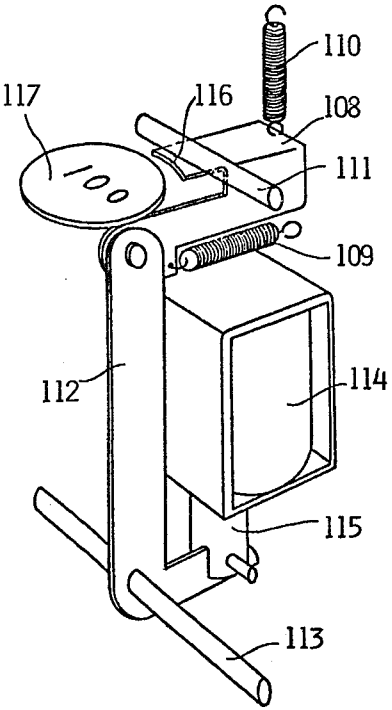
FIG. 11 is a perspective view of a further example of a control unit operable for regulating the delivery of the coins.

FIG. 11 shows a perspective view of a further example of a control unit according to an embodiment of the present invention. The control unit shown in FIG. 11 is operable to dispense a plurality of the coins stacked within the associated coin-shelve. A plurality of the control units correspond to that of the coin-shelves.

In FIG. 11, all the elements denoted as numerals 108 to 115 are respectively related to those of numerals 88 to 95 in FIG. 10. A further description thereof is therefore omitted.

A feature of the control unit shown in FIG. 11 is to provide a coin forcing edge 116 of the dispensing lever 108 as a circular shape. The coin forcing edge 116 is opposed to a coin 117 which should be forwarded. The circular shape formed in the coin forcing edge 116 approximately conforms with that of the coin 17. The coin forcing edge 116 collides with the coin 17 in accordance with the actuation of the dispensing lever 108.

Since the coin forcing edge 116 is formed as the circular shape approximately in accord with that of the coin 17, the coin 17 is protected from being broke off when forced.

A contact region between the coin forcing edge 116 and the coin 17 is considerably enlarged. This explains why dispensing force added to the coin 117 by means of the coin forcing edge 116 is dispersed into the area in contact with the coin forcing edge 116.

Figure 12:
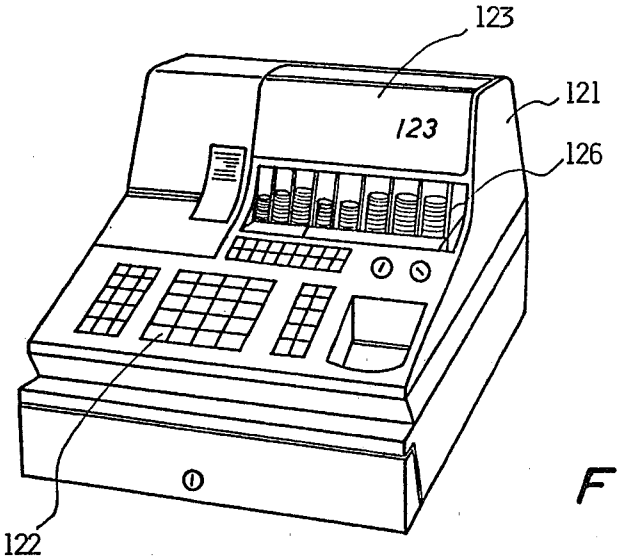
FIG. 12 is a perspective view of a further example of an electronic calculating machine incorporating a further example of a coin dispenser according to a further example of the present invention.
Figure 13:
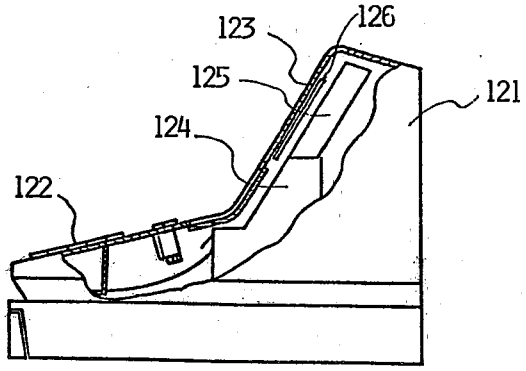
FIG. 13 is a side view with certain parts broken away of the electronic calculating machine illustrated in FIG. 12.

FIG. 12 is a perspective view of a further example of an electronic calculating machine incorporating a further example of a coin dispenser according to a further embodiment of the present invention. FIG. 13 is a side view with certain parts broken away of the electronic calculating machine illustrated in FIG. 12.

With reference to FIGS. 12 and 13, there are provided an electronic calculating machine 121, a plurality of a key switches 122, a display 123, a control unit 124 for a coin dispenser, a plurality of coin-shelves 125, and a window 126.

The plurality of coin-shelves 125 are coupled to the control unit 124 to supply the electronic calculating machine 121 a plurality of coins stacked within the respective coin-shelves 125. The body of the coin-shelves 125 is made up of a transparent material to render a number of the coins disposed in the coin-shelves 125 visible from an external point. The window 126 is disposed so that it is positioned in front of all the coin-shelves 125. Accordingly, the coins stored in the respective coin-shelves 125 are visible from an external point through the window 126.

Under the circumstances, an amount of remaining coins stored can be readily recognized from the external point.

In place of the transparency of the coin-shelves 125 and the presence of the window 126, the coin-shelves 125 may be disposed in front of the main body of the electronic calculating machine 121 by forming it through the use of parts of the main body. In such a case, the respective coin-shelves should be made in a recession shape.

While only certain embodiments of the present invention have been described, it will be apparent to those skilled in the art that various changes and modifications may be made therein without departing from the spirit and scope of the invention as claimed.

What is claimed is:

1. An electronic calculating machine which comprises in combination:

an electronic calculating machine housing having a keyboard panel and a saucer formed in the front surface of said housing with a window portion located above said keyboard panel, a coin holder adapted with a plurality of coin shelves and corresponding reflection plates with associated railway plate and multiple pathways for directing coins ejected from said coin shelves by forwarding members positioned behind said coin shelves into said saucer, said forwarding members being activated by a control unit contained in the body of said coin holder, said coin holder further including a transparent window, said coin holder being retrofitted into the housing of said electronic calculating machine such that said transparent window of said coin holder is positioned above said keyboard panel immediately behind the window portion of said electronic calculating machine housing such that a certain number of coins stored in the coin shelves of said change holder are visible from the outside of said electronic calculating machine, and a kit for retaining operating key units secured on the face of the housing between the saucer and the plurality of coin-shelves.

2. The electronic calculating machine as set forth in claim 1 wherein each of the plurality of coin-shelves of said coin holder is removable from said coin holder.

3. The electronic calculating machine as set forth in claim 1 wherein said coin holder further includes means for controlling the size of the inside area of each of said coin-shelves, the size approximately corresponding to the size defined by the diameter of the coins to be stored, said size controlling means comprising at least one guide plate which is positioned within each coin-shelf.

4. The electronic calculating machine as set forth in claim 3, wherein said size controlling means comprises a pair of guide plates positioned within each of said coin-shelves.

5. The electronic calculating machine as set forth in claim 1 wherein each of the coin-shelves of said coin holder comprises a bent tube in which the plurality of coins are stacked, such that the load resulting from the plurality of coins positioned above the bent portion of the tube is distributed to the corresponding bent side walls of said tube.

6. The electronic calculating machine as set forth in claim 1 wherein said forwarding members comprise levers, the edge of each lever in contact with the coin being circular in shape.

* * * * *